US005928557A

United States Patent [19]

Sanders et al.

[11] Patent Number: 5,928,557

[45] Date of Patent: Jul. 27, 1999

[54] LUBRICANTS FOR COMPRESSOR FLUIDS

[75] Inventors: James Frederick Sanders, Houlton, Wis.; William Mario Lamanna, Stillwater, Minn.

[73] Assignee: Minnesota Mining and Manufacturing Company, St. Paul, Minn.

[21] Appl. No.: 07/865,940

[22] Filed: Apr. 9, 1992

[51] Int. Cl.[6] ..... C09K 5/00; C10M 107/38

[52] U.S. Cl. ..... 252/68; 508/582; 568/615

[58] Field of Search ..... 252/54, 68; 508/582, 508/575, 459; 568/615

[56] References Cited

U.S. PATENT DOCUMENTS

| | | | |
|---|---|---|---|
| 2,918,501 | 12/1959 | Brehm et al. | 260/653.3 |
| 4,154,753 | 5/1979 | Fielding | 260/456 |
| 4,658,078 | 4/1987 | Slaugh et al. | 585/512 |
| 4,668,834 | 5/1987 | Rim | 585/12 |
| 4,814,540 | 3/1989 | Watanabe et al. | 585/523 |
| 4,832,859 | 5/1989 | Basset et al. | 252/51 |
| 4,931,199 | 6/1990 | Bierschenk et al. | 252/68 |
| 4,944,890 | 7/1990 | Deeb et al. | 252/54 |
| 4,967,017 | 10/1990 | Schmid et al. | 568/621 |
| 4,973,412 | 11/1990 | Migdal et al. | 252/49.6 |
| 4,975,212 | 12/1990 | Thomas et al. | 252/52 |
| 5,019,287 | 5/1991 | Derosa et al. | 525/276 |
| 5,032,306 | 7/1991 | Cripps | 252/68 |
| 5,066,410 | 11/1991 | Omure et al. | 252/68 |
| 5,100,569 | 3/1992 | Nalewajek et al. | 252/54 |
| 5,120,459 | 6/1992 | Kalota et al. | 252/54 |
| 5,137,932 | 8/1992 | Behme et al. | 252/68 |
| 5,534,176 | 7/1996 | Nalewajek et al. | 252/68 |
| 5,554,311 | 9/1996 | Katafuchi et al. | 252/68 |

FOREIGN PATENT DOCUMENTS

| | | | |
|---|---|---|---|
| 0 353 935 | 2/1990 | European Pat. Off. | C10M 129/93 |
| 1082127 | 9/1967 | United Kingdom | C07C 21/18 |
| 1143927 | 2/1969 | United Kingdom . | |
| 1508349 | 4/1978 | United Kingdom . | |
| 2012811 | 1/1979 | United Kingdom . | |
| 2245587 | 1/1992 | United Kingdom . | |
| 89/12651 | 12/1989 | WIPO . | |

OTHER PUBLICATIONS

DIN Safety Data Sheet (Jan. 8, 1991) for ICI PLC; Commercial Product Name EMKAROX VG 162.

*Alpha Olefin Applications HandbooK*; Marcel Dekker, Inc.; 1989; Chapter 13.

Shiono et al. *Makromol. Chem. Rapid Commun.* 1990, 11, 169.

Makarov et al *J. Fluorine Chemistry* 1977, 10(4), 323–7.

March, J. *Advanced Organic Chemistry*, 3 ed.; John Wiley & Sons, 1989, pp. 705, 722.

Sorenson et al *Preparative Methods of Polymer Chemistry*; Interscience, 1968, p. 287.

Kaminsky et al. *Makromol. Chem., Rapid Commun.* 1990, 11, 89.

Kaminsky et al. *Agnew. Chem. Int. Ed. Engl.* 1989, 28, 1216.

*Primary Examiner*—Prince Willis

*Attorney, Agent, or Firm*—Carolyn V. Peters

[57] ABSTRACT

A poly-α-olefin:fluoroalkene diblock polymer useful as a lubricant and having a linking moiety of a heteroatom or a heteroatom-containing group linking a poly-α-olefin oligomeric unit with a fluoroalkene oligomeric unit and being miscible in hydrofluorocarbons or a mixture of hydrofluorocarbons, hydrochlorofluorocarbons, chlorofluorocarbons and the miscible composition useful as compressor fluids.

18 Claims, No Drawings

LUBRICANTS FOR COMPRESSOR FLUIDS

FIELD OF THE INVENTION

This invention relates to diblock polymers containing a poly-α-olefin oligomeric unit linked through a heteroatom to a fluoroalkene oligomeric unit that are miscible with refrigerants and their uses in heating and cooling compressors.

BACKGROUND OF THE INVENTION

To date chlorofluorocarbons (CFCs) have been used as refrigerants and propellants. However, it is a chlorofluorocarbon that has been identified as depleting atmospheric ozone. The Montreal Accords restrict the production of chlorofluorocarbons. Potential CFC replacements for these refrigerants include hydrofluorocarbons (HFCs), such as the tetrafluoroethanes, and hydrochlorofluorocarbons (HCFCs), such as difluorochloromethane.

Hydrofluorocarbons are of particular interest as substitute refrigerants because of low toxicity, low ozone depletion potential, low global warming potential, and non-flamability. However, making this substitution is problematic since mineral oil, the lubricant previously used for the CFCs, is not compatible with HFC. Incompatible lubricants will not be properly transported throughout a refrigeration system during operation resulting in improper compressor lubrication and accumulation of lubricant in parts of the refrigeration system. Improper lubrication reduces the efficiency of a refrigeration system, as well as shortening the lifetime of the system.

As discussed in *Alpha Olefin Applications Handbook*; Marcel Dekker, Inc., 1989; Chapter 13, poly α-olefins are well known lubricants. For example, "Mobil 1" (in part poly-1-decene oligomer) and "Shell W" aviation oil holy α-olefin/mineral oil blend) are considered to be particularly useful lubricants for engines, in particular piston engines. Unfortunately, poly α-olefins, like mineral oils, are immisicble in tetrafluoroethane refrigerants.

U.S. Pat. No. 4,832,859 describes lubricants containing at least one compound of the formula:

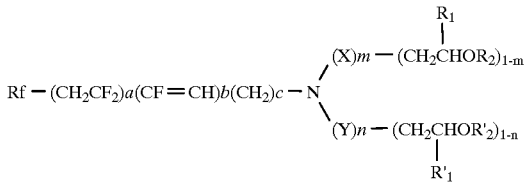

$R_f$ is a perfluorinated radical; a=0 to 10; b=0 to 1 (if a=0 and c=1); c=1 to 4 (2 if a≠0); m=0 or 1; n=0 or 1; X is an aryl radical; Y is a 2-hydroxy-1-phenylethyl group; $R_1$ and $R'_1$ each represent a hydrogen atom or an alkyl, cycloalkyl or aryl radical; $R_2$ and $R'_2$ each represent a hydrogen atom or an acyl residue, at least one of the symbols $R_1$+$R_2$ being other than F or $CH_3$ if the sum of a+m+n=0.

U.S. Pat. No. 4,944,890 describes a blend of refrigerant with at least one fluorinated hydrocarbon, in which the weight ratio of fluorine-to-carbon is from about 0.5 to 5, and which has an SUS viscosity at 100° F. of at least 50, wherein the refrigerant is HFC-134a and the fluorinated hydrocarbon polymer has the formula $(R_f(CH_2)_nCH{=}CH_2)_m$, where the number of carbon atoms in the $R_f$ group is 2 to 20 and n=0 or 1.

U.S. Pat. No. 5,032,306 describes a blend of refrigerant with at least one fluorinated hydrocarbon comprising at least one graft of a perfluoroalkene or a perfluoroalkyvinyl ether onto at least one hydrocarbon having at least four (4) carbon atoms.

U.S. Pat. No. 4, 975,212 describes a lubricating composition comprising a polyoxyalkylene glycol having a cap of a fluorinated alkyl group on at least one terminal end thereof and miscible with tetrafluoroethane or blends of tetrafluoroethane with other refrigerants miscible with the lubricant in the range of about −40° C. to at least 20° C. are included.

U.S. Pat. No. 4,931,199 describes the use of chlorofluoropolyethers, such as perfluoropolyepichlorohydrins as lubricants for cooling systems that employ hydrofluorocarbon refrigerents, such as 1,1,1,2-tetrafluoroethane.

EPO 353 935 describes a lubricant additive comprising at least one terminally unsaturated ethylene α-olefin polymer substituted with mono- or dicarboxylic acid.

A useful review on reactions of the HFIFP oligomers is given in *J. Fluorine Chem.* 1977, 10(4), 323–7.

Furthermore, synthetic methods for derivatizing TFE oligomers has been described in U.S. Pat. No. 4,154,753 and such description is incorporated herein by reference. In that patent, $R_f(OR)_x$ compounds are described wherein the R groups contains a hydrophilic moiety.

SUMMARY OF THE INVENTION

Briefly, in one aspect of this present invention, liquid diblock polymer is provided comprising (a) one poly-α-olefin oligomeric unit containing 8 to 50 carbon atoms derived from an α-olefin monomer having 2 or more carbon atoms; (b) one fluoroalkene oligomeric unit derived from fluoroalkene monomers having 2 to 10 carbon atoms, optionally containing bromine or chlorine, such that when the fluoroalkene monomer is oligomerized, the oligomeric unit has a hydrogen atom content of less than 2% by weight; and (c) at least one linking moiety wherein the linking moiety is a heteroatom, or a heteroatom-containing hydrocarbon or halocarbon group, wherein the heteroatom is nitrogen, oxygen, sulfur, or phosphorus and the halocarbon group contains chlorine, fluorine or bromine, such that the linking moiety links the poly-α-olefin oligomeric unit to the fluoroalkene oligomeric unit.

Suitable α-olefin monomers have at 2 or more carbon atoms, preferably at least 3 carbon atoms and further may be co-polymerized with ethylene. Preferably, once the monomers are oligomerized, suitable poly-α-olefin oligomers contain 8 to 50, preferably 10 to 20 carbon atoms and have at least one site in the oligomer that is functional or can be functionalized.

Suitable fluoroalkene monomers have 2 to 10 carbon atoms, preferably 2 to 6 carbon atoms, more preferably 2 to 4 carbon atoms and preferably, when oligomerized have at least one site in the oligomer that is functional or can be functionalized. The monomers may also contain bromine or chlorine. The fluoroalkene oligomers may be partially fluorinated, such that the hydrogen atom content is less than 2% by weight. Preferably the fluoroalkene oligomer is perfluorinated, that is, essentially all replaceable hydrogen atoms have been replaced with fluorine atoms.

A feature of the invention is the α-olefin monomers and fluoroalkene monomers are oligomerized prior to preparation of the diblock polymer.

Advantageously, the diblock polymers are useful lubricants miscible or compatible with low-boiling, fluorine-containing halocarbons useful as refrigerants, such as chlorofluorocarbons, hydrofluorocarbons hydrochlorofluorocarbons. However, it is preferable to use hydrofluorocarbons, an environmentally safer alternative to chlorofluorocarbons. Suitable hydrofluorocarbons include 1,1,1,2-tetrafluoroethane (HFC-134a), and 1,1,2,2-tetrafluoroethane (HFC-134). The lubricants of this invention are useful with the refrigerants for heating and cooling applications.

In this application:

"oligomer" means a polymer molecule having from 2 to 20 monomer units;

"miscible" means capable of mixing or dissolving in all proportions, used interchangeably with "soluble" and "compatible";

"soluble" means capable of mixing with a liquid (dissolving) to form a homogeneous mixture (solution), used interchangeably with "miscible" and "compatible";

"compatible" means the ability of two or more materials to exist in close and permanent association indefinitely, for example, liquids are compatible if they are misible and do not undergo phase separation upon standing, used interchangeably with "miscible" and "soluble"; "refrigerant" means a low-boiling, fluorine-containing halocarbon, which may also be useful as a propellent or blowing agent;

"block" means an oligomeric unit; and

"diblock polymer" means a copolymer having two different oligomeric units, such as a poly-α-olefin block and a fluoroalkene block.

DETAILED DESCRIPTION OF THE PREFERRED EMBODIMENT

The present invention is a diblock polymer comprising (a) one poly α-olefin oligomeric unit containing 8 to 50, preferably 10 to 20 carbon atoms derived from an α-olefin monomer having 2 or more carbon atoms; (b) one fluoroalkene oligomeric unit derived from fluoroalkene monomers having 2 to 10 carbon atoms, optionally containing chlorine or bromine atoms, such that when the fluoroalkene monomer is oligomerized, the oligomeric unit has a hydrogen atom content of less than 2% by weight; and (c) at least one linking moiety wherein the linking moiety is a heteroatom, or a heteroatom-containing hydrocarbon or halocarbon group, wherein the heteroatom is nitrogen, oxygen, sulfur, or phosphorus and the halocarbon group contains chlorine, fluorine or bromine, such that the linking moiety links the poly-α-olefin oligomeric unit to the fluoroalkene oligomeric unit.

Preferred α-olefin monomers have at least 3 carbon atoms and further may be co-polymerized with ethylene. Once oligomerized, suitable poly-α-olefins contain 8 to 50, preferably 10 to 20 carbon atoms and preferably have at least one site in the oligomer that is functional or can be functionalized.

Poly-α-olefin oligomers are commercially available, for example from Exxon Chem. Co., for example, TETRAMER M or TETRAMER L. Alternatively, poly-α-olefin oligomers can be prepared from commercially available α-olefin monomers using a variety of polymerization processes. Polymerization of olefins in general is described in W. R. Sorenson et al. *Preparative Methods of Polymer Chemistry*; Interscience, 1968, p 287.

Under many conditions the the degree of polymerization of the monomers can be controlled to produce low molecular weight oligomers. For example, a process that produces poly α-olefins with substantially terminal double-bonds is described in Kaminsky et al. *Angew. Chem. Int. Ed. Engl.* 1989, 28, 1216. In U.S. Pat. No. 4,668,834 oligomers are described comprised of mixtures of ethylene and α-olefins having double bonds in the oligomer chain. Non-conjugated dienes can also be incorporated as comonomers into poly-olefin oligomers to provide multiple sites of unsaturation per polymer chain as described in Kaminsky et al. *Makromol. Chem.* 1990, 11, 89. Synthesis of propylene oligomers that retain terminal unsaturation is described in U.S. Pat. No. 4,814,540. A process for preparing α-olefin dimers containing vinylidene unsaturation is described in U.S. Pat. No. 4,658,078.

An advantage of the present invention is maintenance of the chemical integrity and the desirable physical properties of the poly-α-olefin oligomer in the diblock polymer. Poly-α-olefins are excellent lubricants. However, if compatibilizing groups, that is groups that enable miscibility with refrigerants (such as fluoroalkene groups) were grafted to the hydrocarbon chain, such as described in U.S. Pat. No. 5,032,306, lubricant performance would be expected to suffer and the material cost would increase. It is known that properties of block copolymers can differ widely from random or graft copolymers or homopolymers of hybrid monomers. Suprisingly, the diblock polymers of the present invention retain the lubricity properties of the poly-α-olefins while the fluoroalkene oligomer facilitate miscibility with refrigerants.

It has been found desirable in the present invention to use only enough fluoroalkene oligomer in the diblock lubricant to provide compatibility with a refrigerant. This is because poly-α-olefins are much less costly and better lubricants than the fluoroalkene materials. Furthermore, at least one heteroatom connects the fluoroalkene oligomeric unit to the poly-α-olefin oligomeric unit. Heteroatoms, such as O, N, P, and S can hydrogen bond with the relatively acidic hydrogens of the refrigerant, thus improving compatibility of the diblock polymer with refrigerants.

Suitable fluoroalkene monomers have 2 to 10 carbon atoms, preferably 2 to 6 carbon atoms and more preferably 2 to 4 carbon atoms, optionally the monomers also contain bromine or chlorine atoms. Preferably, when the monomers are oligomerized there is at least one site in the oligomer that is functional or can be functionalized. The fluoroalkene oligomers may be partially fluorinated, such that the hydrogen atom content is less than 2% by weight, preferably the fluoroalkene oligomer is perfluorinated, that is, essentially all replaceable hydrogen atoms have been replaced with fluorine atoms.

Preparation of fluoroalkene oligomers useful in this invention is well known. For example, hexafluoropropylene (HFP) dimer and trimer synthesis has been described in U.S. Pat. No. 2,918,501 and such description is incorporated herein by reference. Tetrafluoroethylene (TFE) oligomer preparation has been described in British Patent No. 1,082,127.

Surprisingly, it has been found that poly α-olefin oligomers can be made miscible with hydrofluorocarbon refrigerants by reacting at least one functional site in the poly α-olefin oligomer with a functional site in a fluoroalkene oligomer. This functional site, typically a carbon-carbon double bond may form during the oligomerization process. The poly-α-olefin oligomers may also contain additional functional groups, such as additional double bonds.

The unsaturation in the poly-α-olefin oligomer can be converted to an organic alcohol functionality and in turn can provide a route to the poly-α-olefin:fluoroalkene diblock polymer. The poly-α-olefins can be converted to alcohols by various methods including hydroboration/oxidation or hydroformylation (Oxo process), see March, *J. Advanced Organic Chemistry*, 3d ed.; John Wiley & Sons, 1989, pp 705, 722. In addition to preparing alcohols, suitable alcohols having 8 to 26 carbon atoms are commercially available, for example from Exxon Chem. Corp., under the trade name of EXXAL. The alcohols are monofunctional and are particularly useful in this invention because of their superior lubricating properties. These alcohols are generally prepared from hydroformylation of unsaturated poly-α-olefin oligomers. The unsaturated oligomers are derived from the oligomerization of low boiling α-olefins, mostly propylene with some 1-butene and 1-pentene. The $C_{16}$–$C_{26}$ Guerbet alcohols are preferred and are commercially available from Exxon Chem. Co. under the trade name of EXXAL. Hqwever, the $C_8$–$C_{13}$ alcohols are also useful as precursors to perfluoroalkene diblock that serve as excellent lubricants and/or compatibilizing agents in admixture with the higher viscosity diblock lubricants of this invention or other lubricants useful in heating and cooling systems.

Synthesis of terminally hydroxylated polypropylene oligomers is described in Shiono et al. *Makromol. Chem., Rapid Commun.* 1990, 11, 169. Amines are also accessible from the alcohols and will react with HFP and TFE oligomers in similar fashion to form nitrogen-linked adducts.

The diblock polymers also contain a linking moiety. The linking moiety can be a single heteroatom, such as oxygen, nitrogen, sulfur or phosphorus or a heteroatom-containing hydrocarbon or halocarbon groups wherein the heteroatom is selected from the group consisting of oxygen, nitrogen, sulfur, and phosphorus. The halocarbon group may contain chlorine, fluorine, or bromine in place of hydrogen atoms.

For example, the poly α-olefin alcohol may be linked to the fluoroalkene oligomer by chain extending with polyalkylene glycol prior to reaction with the fluoroalkene oligomer to provide a polyether-linked diblock polymer. Chain extended alcohols can be prepared using a variety of alkylene oxides as described in U.S. Pat. No. 4,967,017 and such description is incorporated herein by reference. Other useful linking groups include esters and polyesters.

Surprisingly, in addition to being useful as lubricants miscible with refrigerants, the diblock polymers of the present invention have a remarkable ability to improve the miscibility of other lubricants known in the art, such as polyalkylene glycol, which in some cases are not sufficiently miscible in refrigerants due to chemical structure or molecular weight.

The diblock polymers of this invention may also be incorporated into lubricant compositions by covalent bonding to other chemical structures, for example, incorporated into a polymer backbone or appended to the polymer backbone. Further, the diblock polymer may be linked together in a repeating fashion, using various synthetic approaches that are known in the art.

As stated above, the diblock polymers are miscible or compatible with low-boiling, fluorine-containing halocarbons useful as refrigerants, such as chlorofluorocarbons, hydrofluorocarbons, hydrochlorofluorocarbons. Typically, the halocarbons have a boiling point below 100° C. The hydrofluorocarbons are preferred as environmentally safer alternatives to chlorofluorocarbons. Suitable hydrofluorocarbons include 1,1,1,2-tetrafluoroethane (HFC-134a), and 1,1,2,2-tetrafluoroethane (HFC-134).

HFC-134a and HFC-134 refrigerants may be blended with each other, as well as with other refrigerants, including, but not limited to $CCl_2F_2$ (CFC-12), $CHClF_2$ (HCFC-22), $CH_3CHF_2$ (HFC-152a), $CHClFCF_3$ (HLCFC-124), $CHF_2CClF_2$ (HCFC-124a), $CH_3CClF_2$ (HCFC-142b), $CH_2F_2$ (HFC-32), $CH_3CF_3$ (HFC-143a), $CHF_2CH_2F$ (HFC-143), and $CF_3CF_2CF_3$ (FC-218).

Useful lubricant viscosities as measured at 40° C. are between 2 and 400 centiStokes. Depending on the application, the desired viscosities for use in compressors are usually 15 to 200 centiStokes at 40° C.

Lubricants are often a mixture of compositions of differing molecular weights. For example, poly-α-olefin:fluoroalkene diblock polymers that have a high molecular weight poly-α-olefin oligomeric units exhibit excellent lubricating properties, but tend not be miscible throughout the required, that is, the application temperature range. However, these are often found to be miscible when blended with fractions of diblock polymers having a lower molecular weight poly-α-olefin oligomeric unit or other lubricants known in the art. The diblock polymer blends of this invention thus may be varied to yield viscosities ranging from 2–400 centipoise at 40° C.

The diblock polymers of the present invention may be blended with each other or with other lubricants, for example, perfluorocarbons, hydrofluorocarbons, fluorochlorocarbons, polyalkylene glycols, pentaerthyritol esters, other ester-based lubricants, naphthenic or paraffinic oils, alkylbenzenes, polyalkylbenzenes to modify viscosity, miscibility, and/or lubrication properties. For example, certain polyalkylene glycols, such as high molecular weight polypropylene glycol, may be immiscible in HFC-134a, although the lower molecular weight homologs are miscible. By blending the diblock polymers of this inventions with these high molecular weight polymers a surprisingly large miscible temperature range is obtained. This feature provides important advantages when optimum miscibility and lubricity is desired within a required viscosity range.

Additives, as known in the art for enhancing performance of the lubricant may be added to the lubricant and include (1) extreme pressure and antiwear additives, (2) oxidation and thermal stability improvers, (3) corrosion inhibitors, (4) viscosity index improvers, (5) pour and floc point depressants, (6) detergent, (7) anti-foaming agents, and (8) viscosity adjusters. Typical members of these classes are described in U.S. Pat. No. 4,975,212 (Table 1) and such description is incorporated herein by reference.

The temperature range for which a lubricant is miscible with the refrigerant is preferably −400 to 100° C. Generally, if the diblock polymer is miscible at low temperatures it will remain miscible at higher temperatures. However, this is not always true for some lubricants, which have immiscible regimes at both high and low temperatures. For any compositions, two critical solution temperatures, that is, lower and a higher temperature, may exist. That is, a relatively low temperature below which two distinct liquid phases are present and above which the two phases become miscible and a higher temperature at which the single phase disappears and two phases again may exist. Advantageously, the present invention can extend the range of miscibility, that is, it tends to decrease the lower temperature and increase the higher temperature. However, it is preferable that the lubricant be miscible over the complete concentration range, that is, from about one to 99 percent lubricant.

Objects and advantages of this invention are further illustrated by the following examples, but the particular materials and amounts thereof recited. In these examples, as well as other conditions and details, should not be construed to unduly limit this invention. All starting materials are commercially available or known in the art unless stated or otherwise apparent.

EXAMPLES

Miscibility is tested by connecting a thick wall glass tube to a cylinder of the refrigerant. A calibrated amount of lubricant is added to the tube and the tube is cooled to about −70° C. in a dry ice-methanol bath. Refrigerant is introduced and allowed to condense to provide a measurable refrigerant volume. The lubricant and refrigerant are stirred over the temperature range of interest. Observations were made between −70° C. to about 40° C. Higher temperatures observations are preferred, however glass tubes that allow visual observations are generally unsafe at the pressures generated above 40° C. A completely miscible mixture is one that does not have multiple liquid layers or phases upon standing or an opaque appearance while stirring at a given temperature.

The temperature dependence of the miscibility at a given lubricant concentration is expressed in terms of a lower and upper critical solution temperature. "Lower critical solution temperature" as used in this application means the temperature below which the mixture of lubricant in refrigerant (usually 25% lubricant, by volume) becomes hazy or opaque due to phase separation. "Upper critical solution temperature" as used in this application means the temperature above which the mixture of lubricant in refrigerant becomes hazy or opaque due to phase separation.

Lubricity was measured using the ASTM D2670 test. Wear was compared to commercial fluids.

Kinematic viscosity measurements were made on a Haake Rotovisco (Model RV3), Searle system rotating viscometer and are reported in centistokes (cSt).

Lubricant compositions and structures were verified by gas chromatography, elemental analysis, infrared spectroscopy and NMR spectroscopy.

Example 1a

This example describes the synthesis of a monounsaturated poly-1-hexene oligomer.

Low molecular weight poly-1-hexene oligomer was prepared by reacting under a dry, nitrogen atmosphere a solution of 3.5 liters of 1-hexene in 500 mL of toluene at 70° C. with a catalyst comprising 12.0 mg of dichlorozirconocene and 22.3 mL of 1.84M methylaluminoxane in toluene (available from Ethyl Corp.). The oligomerization reaction proceeded for approximately 22.5 hours to approximately 50% conversion and was then quenched with 300 mL of methanol. Catalyst residues were extracted by successive washing with two 600 mL portions of 3M aqueous hydrochloric acid, 900 mL of 10% aqueous potassium carbonate and three 1,500 mL portions of distilled water. Toluene and unreacted monomer were removed by fractional distillation at 2.7 kPa (20 Torr) to yield 1.1 kilograms of pure poly-1-hexene oligomer. Proton ($^1$H) NMR analysis indicated that the isolated oligomers had an average degree of polymerization of 4.5 ($M_n$=379). Comparisons with molecular weight data from gel permeation chromatography (GPC), vapor pressure osmometry (VPO), and supercritical fluid chromatography (SFC) of previous poly-1-hexene samples prepared by this method showed excellent correlation with the NMR calculated values. This, along with data from GC-MS analysis indicated each oligomer was monounsaturated. Furthermore, NMR data revealed that 90% of the double bonds were of the terminal vinylidene type, the remaining 10% were internal 1,2-disubstituted or trisubstituted double bonds.

Poly-1-hexene oligomers with degrees of polymerization ranging from 2 to at least 100 have been made. Various other poly-1-olefins derived from propylene, 1-octene, 1-decene, for example, can be made in like manner.

Example 1b

This example describes converting the monounsaturated poly-1-hexene oligomer as prepared in Example 1a to a monofunctional alcohol.

A dry 5 liter, 3-necked round bottom flask equipped with a mechanical stirrer and addition funnel was charged with 800 mL of anhydrous tetrahydrofuran (THF) and 224.3 grams of poly-1-hexene oligomer as prepared in Example 1a. The solution was purged with nitrogen for 30 minutes and cooled to 0° C. in an ice bath. The addition funnel was loaded with 460 mL of 1.0M borane THF in THF that was added dropwise to the poly-1-hexene solution at 0° C. with stirring. After 30 minutes, the ice bath was removed and the reaction vessel and solution were gradually warmed to room temperature. After a total reaction time of approximately 17 hours, 300 mL of 3.0M aqueous NaOH was added with vigorous stirring at 0° C. in a dropwise manner. This was followed immediately by the rapid dropwise addition of 300 mL of 30% aqueous hydrogen peroxide at 0° C. with stirring. Once addition was complete, the ice bath was removed and replaced with a large warm water bath set initially to 50° C. The reaction proceeded for an additional 4 hours. To the final product mixture was added 527 grams of potassium carbonate with stirring. The mixture was transferred to a separatory funnel and the two layers separated. The upper organic phase was dried over 75 grams of anhydrous magnesium sulfate, filtered by suction and evaporated at 80° C., 2.7 kPa (20 Torr) to remove most of the residual THF solvent. A clear colorless oil was recovered and according to GC analysis, contained 96% poly-1-hexene-OH and 4% unreacted poly-1-hexene oligomer. $^1$H and $^{13}$C NMR analysis indicated the product contained predominantly primary alcohol functionality and only a single —OH group per chain.

Example 1c

This example describes converting the poly-1-hexene alcohol as prepared in Example 1b to the corresponding poly-1-hexene ether-linked hexafluoropropylene (HFP) trimer diblock polymer.

HFP trimer starting material was prepared by fluoride ion-initiated oligomerization of HFP monomer in dimethylformamide (DMF) solvent and separated into dimer and trimer fractions by fractional distillation. A 2.0 liter, two-necked flask equipped with mechanical stirrer and a condenser with nitrogen inlet was loaded with 276.5 grams of HFP trimer, 200 grams of poly-1-hexene alcohol as prepared in Example 1b and 214 mL of triethylamine. The mixture was heated to 60° C. under a nitrogen atmosphere and mixed at a high rate of speed (about 500 rpm). The reaction proceeded for approximately 46 hours, after such time a single liquid phase was observed, as well as a white crystalline precipitate of triethylammonium fluoride. The triethylammonium fluoride and residual triethylamine was removed by successive washings with 3M aqueous sulfuric acid, 10% aqueous potassium carbonate and water. The oil was then dried over anhydrous magnesium sulfate and filtered. Residual volatiles were removed by heating to 90°

C. in vacuo to yield 316 grams of diblock lubricant. Infrared (IR) analysis of the undiluted oil indicated 100% of the alcohol groups were converted. GC analysis confirmed all the oligomeric alcohols were reacted and oligomer peaks assigned to the diblock polymer were observed. Titration analysis according to ASTM method D664-89 showed the oils prepared according to this procedure contained small amounts of weak acid impurities. The acid impurities were removed by filtration of the undiluted oil through a bed of 70–230 mesh silica gel leaving a light yellow oil product. Kinematic viscosity of the undiluted oil was 46.64 cSt at 40° C.

Example 1d

This example describes determination of compatibilities of a diblock polymer with a refrigerant.

Compatibility of the poly-1-hexene-O-HFP trimer diblock polymer as prepared in Example 1c with refrigerant HFC-134a was examined by charging a heavy-walled glass Fischer-Porter bottle with 1.83 grams of oil and approximately a three-fold excess (y volume) of HFC-134a at −40° C., then sealing the vessel and gradually varying the temperature between −70° C. and 40° C. Solubility was judged to be complete when the lubricant and refrigerant formed a single homogenous phase and visible haze disappeared. The lubricant appeared to be insoluble or very slightly soluble in the refrigerant at −30° C., but was partially soluble at 25° C. and above.

Example 1e

This example describes the testing of thermal stability of a diblock polymer of this invention.

Thermal stability of the diblock lubricant as prepared in Example 1c was examined by heating the undiluted oil to 200° C. under a nitrogen atmosphere for a period of approximately 4 hours. No change was observed in either the physical appearance or the IR spectrum of the undiluted oil, thus indicating thermally stable under these conditions.

Example 2

This invention describes the preparation of a polypropylene-O-HFP trimer diblock polymer containing an intermediate ether linkage. The polymer was tested for solubility in HFC-134a and thermal stability.

Guerbet alcohol (commercially available from Exxon Chem. Co., under the trade name EXXAL) (117.6 grams) containing a highly branched $C_{20}H_{41}$ aliphatic chain and a single primary alcohol functionality was reacted with 253.4 grams of HFP trimer and 156 grams of triethylamine according to the procedure as described in Example 1c. Polypropylene-O-HFP trimer diblock polymer was isolated as a light yellow oil following column chromotography.

Compatibility of the diblock polymer with HFC-134a was examined as described in Example 1d. From approximately −5° C. to 40° C., the diblock polymer was completely soluble in HFC-134a, evidenced by a single, clear, liquid phase.

Thermal stability of the diblock polymer was examined according to the procedure described in Example 1e. The diblock polymer was thermally stable up to at least 200° C.

Example 3

This example describes the preparation of a polypropylene-O-HFP trimer diblock polymer containing an intermediate ether linkage. The polymer was tested for solubility in HFC-134a, thermal stability, and lubricity.

Guerbet alcohol (commercially available from Exxon Chem. Co., under the trade name EXXAL) (195.6 grams) containing a highly branched $C_{26}H_{53}$ aliphatic chain and a single primary alcohol functionality was reacted with 253.4 grams of HFP trimer and 156 grams of triethylamine according to the procedure described in Example 1c. Polypropylene-O-HFP trimer diblock polymer was isolated as a light yellow oil following column chromotography.

Compatibility of the diblock lubricant with HFC-134a was examined as described in Example 1d. At 25% (by volume) oil in HFC-134a, approximately 30–50% of the oil dissolved in HFC-134a at 40° C. The Exxal alcohol starting material was found to be completely incompatible in HFC-134a between −70° C. and 40° C. This illustrates the advantages of the diblock polymers of this invention over the poly-α-olefin oligomer alcohols alone.

Thermal stability of the diblock polymer was examined according to the procedure described in Example 1e. The polymer was thermally stable up to at least 200° C.

The lubricity of the polymer of this example was tested in a Falex Wear Tester according to ASTM D2670. The polymer was compared to polypropylene oxide (PPO, commercially available from Aldrich Chem. Co., as polypropylene glycol, average MW of 1000). Under equivalent loadings, the diblock polymer of this example was run for 15 minutes with minor wear on the test elements while the PPO lubricant failed after 35 seconds with severe damage to the test surfaces that resulted in the breaking of the drive shear pin. This test establishes the lubricity advantages of the diblock polymers of this invention over polypropyene oxide.

Example 4

This example describes the preparation of a polypropylene-O-TFE oligomer diblock polymer containing an intermediate ether linkage. The polymer was tested for solubility in HFC-134a and thermal stability.

Guerbet alcohol (as described in Example 2) was converted to the corresponding polypropylene ether-linked TFE oligomer diblock polymer by reaction with a mixture of monounsaturated TFE oligomers. The TFE oligomer starting material was prepared by bifluoride ion-initiated oligomerization of TFE monomer in DMF solvent and was a mixture of $C_8$ (12%), $C_{10}$ (58%) and $C_{12}$ and $C_{14}$ (30%) perfluorinated oligomer chains. Reaction of 9.78 grams of alcohol with 20.00 grams of TFE oligomer and 9.93 grams of triethylamine according to the procedure described in Example 1c produced polypropylene-O-TFE oligomer as a light yellow oil following column chromatography.

Compatibility of the diblock polymer with HFC-134a was examined as described in Example 1d. From approximately 19° C. to 40° C., the polymer was substantially soluble in HFC-134a as evidenced by a single liquid phase.

Thermal stability of the diblock polymer was examined according to the procedure described in Example 1e. The lubricant was thermally stable up to at least 200° C.

Example 5

This example describes the preparation of a polypropylene-O-HFP trimer diblock polymer containing an intermediate ether linkage. The polymer was tested for solubility in HFC-134a and thermal stability.

Guerbet alcohol (commercially available from Exxon Chem. Co., under the trade name EXXAL) (123.9 grams)

containing a highly branched $C_{16}H_{33}$ aliphatic chain and a single primary alcohol functionality was reacted with 253.4 grams of HFP trimer and 156 grams of triethylamine according to the procedure described in Example 1c. Polypropylene-O-HFP trimer diblock polymer was isolated as a light yellow oil following column chromotography.

Compatibility of the diblock polymer with HFC-134a was examined as described in Example 1d. From −33° C. to 40° C., the polymer was substantially soluble in HFC-134a as evidenced by a single, clear, liquid phase.

Thermal stability of the diblock polymer was examined according to the procedure described in Example 1e. The polymer was thermally stable up to at least 200° C.

Example 6

This example describes the preparation of polypropylene-O-HFP trimer diblock polymer containing an intermediate ether linkage. The polymer was tested for solubility in HFC-134a.

An alcohol (commercially available from Exxon Chem. Co., under the trade name EXXAL) (99.6 grams) containing a highly branched $C_{13}H_{27}$ aliphatic chain and a single primary alcohol functionality was reacted with 247.5 grams of HFP trimer and 152 grams of triethylamine according to the procedure described in Example 1c. A 71% yield of polypropylene-O-HFP trimer was isolated as a light yellow oil following column chromotography.

Compatibility of the diblock polymer with HFC-134a was examined as described in Example 1d. From −41 ° C. to 40° C., the polymer was completely soluble in HLFC-134a as evidenced by a single, clear, liquid phase.

Example 7

This example describes the preparation of a n-decane-O-HFP trimer diblock polymer containing an intermediate ether linkage. The polymer was tested for solubility in HFC-134a.

Linear n-decanol (commercially available from Aldrich Chem. Co.) was reacted with a 10% molar excess of HFP trimer and a three-fold molar excess of triethylamine according to the procedure described in Example 1c. A nearly quantitative yield of n-decane-O-HFP trimer diblock polymer was isolated as a yellow-orange oil.

Compatibility of the diblock polymer with HFC-134a was examined as described in Example 1d. The oil was completely soluble in HFC-134a at temperatures as low as −55° C. and as high as 40° C., as evidenced by a single, clear, liquid phase within this temperature range.

Examples 8–16

These examples as shown in Table 1 summarize the compatibility testing results of several blends of high and low MW diblock polymers. Blends of this example were 50:50 mixtures by weight of two different diblock polymers. Compatibilities of these mixtures were determined according to the procedure of Example 1d using 25% (by volume) total polymer in HFC-134a and are expressed in terms of a lower critical solution temperature. Lower critical solution temperatures of the pure polymers are included for comparison. In every case, upper critical solution temperatures were not observed up to 40° C. Note: Upper critical solution temperatures above 40° C. could not be probed due to the pressure limitations of the glass pressure vessel. Also note: "HFPT" means hexafluoropropylene trimer. Kinematic viscosity measurements at 40° C. were made for Examples 8 to 11 and are 5.44 cSt, 10.86 cSt, 15.61 cSt, and 23.57 cSt, respectively.

TABLE 1

| Example | Lubricant Mixture | Lower Critical Solution Temperature (° C.) |
|---|---|---|
| 8 | n-$C_{10}H_{21}$—O—HFPT | −55 |
| 9 | $C_{13}H_{27}$—O—HFPT | −41 |
| 10 | $C_{16}H_{33}$—O—HFPT | −33 |
| 11 | $C_{20}H_{41}$—O—HFPT | −5 |
| 12 | $C_{26}H_{53}$—O—HFPT | >+40 (partially insoluble) |
| 13 | 50:50 Blend of $C_{13}H_{27}$—O—HFPT and $C_{20}H_{41}$—O—HFPT | −21 |
| 14 | 50:50 Blend of $C_{16}H_{33}$—O—HFPT and $C_{20}H_{41}$—O—HFPT | −16 |
| 15 | 50:50 Blend of $C_{16}H_{33}$—O—HFPT and $C_{13}H_{27}$—O—HFPT | −41 |
| 16 | 50:50 Blend of n-$C_{10}H_{21}$—O—HFPT and $C_{20}H_{41}$—O—HFPT | −25 |

Examples 17–22

These example as shown in Table 2 summarize the compatibility testing results of various blends of diblock polymers with polyalkylene glycols. Blends of this example were 50:50 mixtures by weight of the diblock polymer and the polyalkylene glycol lubricant. Compatibilities of these mixtures were determined according to the procedure described in Example 1d using 25% (by volume) total polymer in HFC-134a and are expressed in terms of a lower critical solution temperature in the following table. Lower critical solution temperatures of the pure polyalkylene glycol lubricants are included for comparison. Upper critical solution temperatures, when observed are also listed. Note: Upper critical solution temperatures above 40° C. could not be probed due to the pressure limitations of the glass pressure vessel. Single temperature entries refer to the lower critical solution temperature.

TABLE 2

| Example | Lubricant | Lower/Upper Critical Solution Temperatures (° C.) |
|---|---|---|
| 17* | EO-capped PPG, MW = 2,800 | >+32 (insoluble at all temps) |
| 18† | EO-capped PPG, MW = 2,800 and $C_{16}H_{33}$—O—HFPT | −47/+20 |
| 19* | PPG Triol, MW = 4,100 | >+33 (insoluble at all temps) |
| 20 | PPG Triol, MW = 4,100 and $C_{16}H_{33}$—O—HFPT | −41/+15 |
| 21‡ | EMKAROX ™ VG 162 | >+35 (insoluble at all temps) |
| 22†‡ | EMKAROX ™ VG 162 and $C_{16}H_{33}$—O—HFPT | −54/+35 |

*ethylene oxide-capped polypropylene glycol (EO-capped PPG) and PPG triol available from Aldrich Chem. Co.

†prepared from $C_{16}H_{33}$ alcohols available from Exxon Chem. Co. under the trade name EXXAL ‡EMKAROX VG 162 is a polyoxyalkylene glycol under the trade name owned by ICI Chemicals & Polymers Ltd.

Examples 23–24

These examples illustrate the advantages of using a polyalkylene glycol as the linking moiety between the poly-α-olefin oligomeric unit and the fluoroalkene oligomeric unit of the diblock polymer to increase molecular weight and viscosity without significantly reducing the solubility of the diblock polymer in HFC-134a. Propylene oxide-extended EXXAL alcohols were provided by Dow Chemical Co. Compatability was determined according to the procedure described in Example 1d.

| Example | Lubricant Mixture | Lower Critical Solution Temperature (° C.) |
|---|---|---|
| 23† | $C_{13}H_{27}$—O—HFPT | −41 |
| 24† | $C_{13}H_{27}(OCH_2CHMe)_5O$—HFPT | −37 |

†prepared from $C_{13}H_{27}$ alcohols available from Exxon Chem. Co. under the trade name EXXAL Examples 25–26

These examples illustrate the compatibility of diblock polymers of the present invention with chlorofluorocarbon and hydrochlorofluorocarbon refrigerants. Compatability was determined according to the procedure described in Example 1d.

| Example | Lubricant Mixture and Refrigerant | Lower Critical Solution Temperature (° C.) |
|---|---|---|
| 25† | $C_{16}H_{33}$—O—HFPT and $CCl_2F_2$ (CFC-12) | −41 |
| 26† | $C_{16}H_{33}$—O—HFPT and $CHClF_2$ (HCFC-22) | −37 |

†prepared from $C_{16}H_{33}$ alcohols available from Exxon Chem. Co. under the trade name EXXAL Various modifications and alterations of this invention will become apparent to those skilled in the art without departing from the scope and spirit of this invention, and it should be understood that this invention is not to be unduly limited to the following illustrative embodiments set forth herein.

We claim:

1. A miscible composition comprising:

(1) a low-boiling, fluorine-containing halocarbon;

(2) a di-block polymer, wherein the di-block polymer comprises:

(a) one poly-α-olefin oligomeric unit containing 8 to 50 carbon atoms derived from an α-olefin monomer having 2 or more carbon atoms;

(b) one fluoroalkene oligomeric unit derived from flucroalkene monomers having 2 to 10 carbon atoms, such that the oligomeric units has a hydrogen atom content of less than 2% by weight; and (c) at least one linking moiety wherein the linking moiety is an oxygen or an oxygen-containing group, such that the linking moiety links the poly-α-oiefin oligomeric unit to the fluoroalkene oligomeric unit.

2. The composition according to claim 1, wherein the fluoroalkene oligomeric unit contains bromine or chlorine atoms.

3. The composition according to claim 1, wherein the linking moiety is an aikylene glycol, polyalkylene glycol, an ester, or a polyester.

4. The composition according to claim 1 further comprising other lubricants and additives.

5. The composition according to claim 1, wherein the low-boiling, fluorine-containing halocarbon is a hydrofluorocarbon, a hydrochlorofluorocarbon or a mixture thereof.

6. The composition according to claim 5, further comprising a chlorofluorocarbons a perfluorocarbon, or a mixture thereof.

7. The composition according to claim 5, wherein the hydrofluorocarbon is 1,1,1,2-tetrafluoroethane or 1,1,2,2-tetrafluoroethane.

8. The composition according to claim 1, wherein the fluoroalkene oligomeric unit is a hexafluoropropylene oligomer or a tetrafluoroethylene oligomer.

9. The composition according to claim 1, wherein the poly-α-olefin oligomeric unit is a poly-α-olefin alcohol containing 10 to 20 carbon atoms.

10. The miscible composition according to claim 1, wherein the diblock polymer comprises a poly-α-olefin oligomeric unit containing 16 carbon atoms, a hexafluoropropylene trimer, linked together with an oxygen atom and miscible in 1,1,1,2-tetrafluoroethane.

11. The miscible composition according to claim 1, wherein the diblock polymer comprises a poly-α-olefin oligomeric unit containing 20 carbon atoms, a hexafluoropropylene trimer, linked together with an oxygen atom and miscible in 1,1,1,2-tetrafluoroethane.

12. A lubricant comprising:

a di-block polymer comprising:

(1) one poly-α-olefin oligomeric unit containing 8 to 50 carbon atoms derived from an α-olefin monomer having 2 or more carbon atoms;

(2) one fluoroalkene oligomeric unit derived from fluoroalkene monomers having 2 to 10 carbon atoms, such that the oligomeric units has a hydrogen atom content of less than 2% by weight; and (3) at least one linking moiety wherein the linking moiety is an oxygen or an oxygen-containing group, such that the linking moiety links the poly-α-olefin oligomeric unit to the fluoroalkene oligomeric unit.

13. The composition according to claim 12, wherein the linking moiety is an alkylene glycol, polyalkylene glycol, an ester, or a polyester.

14. The composition according to claim 12, wherein the fluoroalkene oligomeric unit is a hexafluoropropylene oligomer or a tetrafluoroethylene oligomer.

15. The composition according to claim 12, wherein the poly-α-olefin oligomeric unit is a poly-α-olefin alcohol containing 10 to 20 carbon atoms.

16. A compressor fluid comprising a blend of diblock polymers according to claim 12 and a hydrofluorocarbon comprising 1,1,1,2-tetrafluoroethane or 1,1,2,2-tetrafluoroethane.

17. The compressor fluid according to claim 16 further comprising a chlorofluorocarbons a perfluorocarbon, a hydrochlorofluorocarbon or a mixture thereof.

18. A lubricant comprising a diblock polymer according to claim 12 further comprising polyalkylene glycol, ester-based lubricants, or mixtures thereof.

* * * * *